United States Patent [19]

Girault

[11] Patent Number: 4,825,962

[45] Date of Patent: May 2, 1989

[54] DRILLING SYSTEM

[75] Inventor: Alain Girault, Le Vesinet, France

[73] Assignee: Forasol, Velizy-Villacoublay, France

[21] Appl. No.: 96,737

[22] Filed: Sep. 15, 1987

[30] Foreign Application Priority Data

Sep. 15, 1986 [FR] France ..... 8612868

[51] Int. Cl.[4] ..... E21B 19/20

[52] U.S. Cl. ..... 175/26; 173/2; 173/11; 175/52

[58] Field of Search ..... 175/24, 26, 52; 173/2, 173/4, 11; 414/22

[56] References Cited

U.S. PATENT DOCUMENTS

| | | | |
|---|---|---|---|
| 3,872,932 | 3/1975 | Gosselin | 175/26 X |
| 4,354,233 | 10/1982 | Zhukovsky et al. | 364/420 |
| 4,407,017 | 9/1983 | Zhilikov et al. | 175/24 X |
| 4,421,179 | 12/1983 | Boyadjieff | 173/44 |
| 4,491,186 | 1/1985 | Alder | 175/26 |
| 4,591,006 | 5/1986 | Hutchison et al. | 175/52 |
| 4,604,724 | 8/1986 | Shaginian et al. | 175/24 X |

FOREIGN PATENT DOCUMENTS

| | | |
|---|---|---|
| 2559540 | 8/1985 | France . |
| 1291655 | 4/1972 | United Kingdom . |
| 2057694 | 4/1981 | United Kingdom . |

*Primary Examiner*—William P. Neuder

*Attorney, Agent, or Firm*—Schweitzer & Cornman

[57] ABSTRACT

The invention relates to a drilling system. It includes, in combination, a drilling derrick by means of which a string of drill rods can be suspended from a hoist, a motorized drilling head at the end of the hoist, means for bringing a drill rod into position to be added to the drill string from a stack, a motor to drive the hoist, a reversible control for the said hoist motor, sensors for determining the state of the system, and a programmable robot to supply the set points to the hoist motor control according to signals furnished by the said system state sensors.

2 Claims, 1 Drawing Sheet

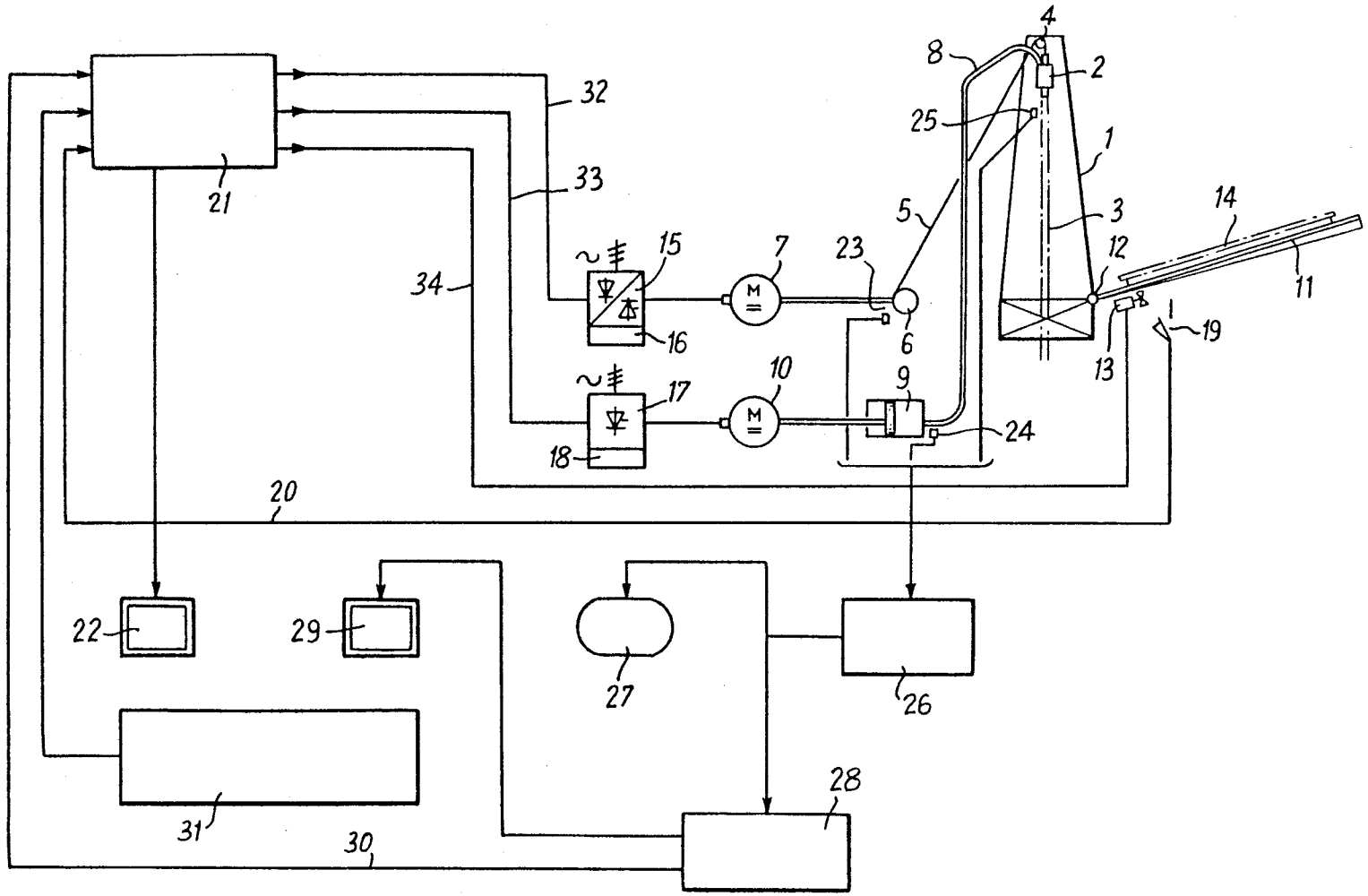
1
2
3
4
5
6
7
8
9
10
11
12
13
14
15
16
17
18
19
20
21
22
23
24
25
26
27
28
29
30
31
32
33
34

DRILLING SYSTEM

BACKGROUND OF THE INVENTION

The present invention relates to a drilling system.

Drilling, particularly oil-well drilling, is performed by means of a string of drill rods bearing a drilling tool at its bottom end, and driven in rotation at its top part. The upper end of the drill string is supported by a hoist through the medium of a block mounted at the top of a drilling derrick.

In the latest drilling installations, the rotation of the drill string is performed by means of a hydraulic motor installed on a motor-driven drilling head disposed between the hoist and the upper end of the string of rods. The injection of mud into the drill string is also performed from this drilling head.

Also known are drilling installations in which the successive additions of rods to the upper part of the drill string already in place are performed with the aid of an arm capable of picking the individual rods from a stack in which they are disposed horizontally, and of bringing them to the vertical above the drill string where they are then screwed at their upper end to the drive head and at their lower end to the upper end of the drill string already in place.

All these operations as well as the control of the mud pumps and hoist are performed manually.

In particular, the motor of the hoist is used only for raising the string of rods. During the drilling this motor is disengaged from the hoist and the descent of the string of rods is controlled by means of a manually operated drum brake. When a rapid descent is necessary, an electromagnetic retarder is also used.

The operator of the drilling installation therefore has at his disposal, for the control of the hoist alone, four controls, viz., the clutch, the drum retarder, the electromagnetic retarder and the hoist motor control.

Other workers must furthermore check the operation of the mud pumps and especially perform the operations of adding drill rods.

The operation of a drilling installation therefore calls for complex operations which have to be performed by a numerous crew under generally difficult conditions.

The present invention aims to relieve this difficulty.

SUMMARY OF THE PRESENT INVENTION

To this effect, the invention has as its subject matter a drilling system characterized in that it includes, in combination, a drilling derrick from which a string of rods can be suspended by a hoist, a motor-driven drilling head at the end of the hoist, means for bringing a drill rod into position to be added from stock to the string of rods, a motor for driving the hoist, a reversing control for the said hoist motor, sensors for determining the state of the system, end a programmable robot to supply the set points (desired values) for the control of the hoist motor according to the signals furnished by the said sensors.

The use of a reversing control on the hoist motor makes it possible, first of all, to use the motor during drilling to control the weight exerted on the drill. Difficulties connected in known installations with the control of the weight by the drum brake, which can be only approximate, are thus eliminated.

Otherwise, the motor is permanently engaged and the control also permits the elimination of the electromagnetic retarder. In manual operation, the operator therefore has a single control instead of four, viz., the motor control, and this greatly facilitates his task.

Moreover, the programmable robot, in combination with the reversing control, offers other advantages.

First of all, the control makes it possible to position the movable equipment precisely with respect to the derrick. The result is that the rod adding operations can be much more easily automated.

Furthermore, the control makes it possible to provide automatically for the compensation of the screwing torque by coordinating the hoisting motor with the drilling motor. Thus, the operating head automatically descends when it is screwed onto a rod, and automatically rises when it is unscrewed, while the rod remains fixed in relation to the derrick.

In one particular embodiment, the drilling system according to the invention includes at least one mud pump which can inject the mud into the drill train through the motor-driven drilling head, a pump motor to drive the mud pump, and a unidirectional control for the pump motor, the said programmable robot being arranged to supply also the set points for the control of the pump motor.

It is furthermore possible to render the drilling completely automatic by arranging the programmable robot to supply the commands to the auxiliary motorization means of the system.

Sensors can also be provided to determine the drilling parameters, the signals delivered by these drilling parameter sensors being sent to the programmable robot.

The robot can thus take into account not only the state of the system, essentially defined by the relative position of its various parts, but also drilling parameters such as the speed and torque, mud pressure, the weight applied to the drill, etc.

In one particular embodiment, the signals put out by the drilling parameter sensors are sent to the programmable robot through the medium of an electronic computer containing a model of the borehole, in order to compute optimized drilling parameters.

In this embodiment, the computer itself determines at every moment, on the basis of the model that has been given to it, the optimized parameters which are supplied to the programmable robot so that the latter may control the various parts of the system accordingly.

One particular embodiment of the invention will now be described with reference to the appended drawing, which consists of a diagram of a drilling system according to the invention.

DESCRIPTION OF THE DRAWING

The drawing represents a drilling derrick 1 supporting a drill string 3 by means of a drilling head 2, powered for example by a hydraulic motor.

DETAILED DESCRIPTION OF THE INVENTION

The motor-powered head 2 is mounted at the end of a block 4 connected by a cable 5 to a hoist 6. The hoist 8 is driven by a direct-current motor 10.

A raising arm 11, mounted for pivoting about a horizontal axis 12, and operated by means of a jack 13, permits the rods 14 to be taken from a horizontal stack and raised to the vertical at the motor-powered head 2 to enable them to be added to the upper end of the drill train 3.

The arm 11 also makes it possible, when the drill train is raised, to take them one by one in their vertical position after they have been unscrewed, and then bring them back to their place on the horizontal rod stack.

The motor 7 is powered by direct current from a thyristor converter 15 controlled by a reversing control 16. The motor 10 is fed with direct current from a converter 17 controlled by a unidirectional control 18.

Sensors, such as an end-of-travel sensor 19, which detects the arrival of the arm 11 at the horizontal position, have their outputs delivered through lines 20 to the input of a programmable robot 21. A viewscreen 22 connected to the robot 21 enables the operator to see the state of the system, i.e., in what phase of operation each of its parts is engaged.

Other sensors, such as the sensor 23 which detects the speed of rotation of the hoist 6, the sensor 24 which detects the pressure at the output of the drilling mud pump 9, or the sensor 25 detecting the rotatory speed of the drill train 3, make it possible to determine the drilling parameters. These parameters are sent to the input of an electronic processing unit 26 which processes them before delivering them on the one hand to the viewscreen 27 and on the other hand to a computer 28.

The computer 28 contains in memory a mathematical model of the bore hole based on input data, which enables it to compute optimized drilling parameters which are transmitted on the one hand to the viewscreen 29 and on the other hand, through lines 30, to the input of the programmable robot 21.

Finally, a console 31 enables the operator to control the different functions of the system manually.

On the basis of the data put into it from the lines 20 and 30, the programmable robot 21 outputs the set points for the control 16 through lines 32, the set points for the control 18 through lines 33, and the control commands for the different auxiliary functions, e.g., the control of the jack 13 of the arm 11 through the lines 34.

The programmable robot 21 therefore makes possible the complete automation of the drilling, while the computer 28 makes it possible to optimize the parameters.

More particularly, the motor 7 governed by the reversing control 16 provides for the positioning of the motor-powered drilling head 2 with respect to the derrick, controlling the weight exerted on the tool, and assuring the torque compensation when a rod 14 is screwed onto or unscrewed from the head 2.

The mud pressure supplied by the pump 9 is also automatically controlled by the controller 18.

Variants and modifications can, of course, be added to the preceding description without thereby departing from the scope or the spirit of the invention.

Thus, in particular, only a few sensors have been represented, but a much larger number of such sensors is necessary for completely automatic operation. The person skilled in the art can easily determine the nature and the location of these sensors, such as those, for example, which determine the position of the drilling head with respect to the derrick.

Likewise, the sole auxiliary function represented was the control of the raising arm, but it is obvious that other controls are provided, such as those for the rotation of the motorized drilling head, the rod grapples, or the rod-holding means on the arm.

I claim:

1. A drilling system comprising a drilling derrick having a hoist mounted thereon, a motorized drilling head suspended from said hoist for supporting and pivoting a string of drill rods, means for bringing a drill rod into position to be added to the drill string from a stack a direct current electric raising and lowering motor for driving the hoist, and a thyristor convertor means controlled by a reversing control means for controlling said electric motor.

2. Drilling system according to claim 1, characterized by the fact that it includes at least one mud pump (9) which can inject the mud into the drill string through the said motorized drilling head, a pump motor (10) for driving the mud pump, and a unidirectional control (18) for the said pump motor.

* * * * *